US005105531A

United States Patent [19]

Sawada et al.

[11] Patent Number: 5,105,531

[45] Date of Patent: Apr. 21, 1992

[54] METHOD OF MANUFACTURING A COIL OF INSULATED WIRE

[75] Inventors: Kazuo Sawada; Shinji Inazawa; Kouichi Yamada, all of Osaka, Japan

[73] Assignee: Sumitomo Electric Industries, Ltd., Osaka, Japan

[21] Appl. No.: 596,534

[22] Filed: Oct. 12, 1990

[30] Foreign Application Priority Data

Oct. 13, 1989 [JP] Japan ..... 1-266569

[51] Int. Cl.[5] ..... H01F 41/06

[52] U.S. Cl. ..... 29/605; 174/120 A; 174/120 C; 427/118; 427/126.3

[58] Field of Search ..... 29/605, 596; 174/110 A, 174/120 R, 120 C; 427/118, 126.2, 126.3

[56] References Cited

U.S. PATENT DOCUMENTS

| | | | |
|---|---|---|---|
| 2,848,794 | 8/1958 | Roth | 174/110 A |
| 3,109,053 | 10/1963 | Ahearn | 174/110 A |
| 3,352,009 | 11/1967 | Cohn et al. | 29/605 |
| 3,359,630 | 12/1967 | Metz | 29/605 |
| 3,425,121 | 2/1969 | Ostrander et al. | 29/605 |
| 4,291,457 | 9/1981 | Heyrand | 29/605 X |

FOREIGN PATENT DOCUMENTS 63-237404 10/1988 Japan .

*Primary Examiner*—Carl E. Hall

*Attorney, Agent, or Firm*—W. G. Fasse; D. H. Kane, Jr.

[57] ABSTRACT

A method of manufacturing an insulated wire coil is performed by covering the outer peripheral surface of a conductor with a mineral insulating layer, then coating the mineral insulating layer with a precursor solution of an oxide insulating material prior to winding the wire into a coil. After completion of the coil the precursor solution is dried.

5 Claims, 1 Drawing Sheet

METHOD OF MANUFACTURING A COIL OF INSULATED WIRE

FIELD OF THE INVENTION

The present invention relates to a method of manufacturing a coil of wire which is insulated by a mineral material.

BACKGROUND INFORMATION

An MI cable is an example of a heat-resistant insulated wire. Such MI cable also known as mineral insulated cable which is formed by inserting a conductor into a heat-resistant alloy tube of a stainless steel alloy etc. charged with fine particles of a metal oxide such as magnesium oxide, or a glass braided tube insulated wire, said tube being made of textile glass fiber forming an insulating member, and the like. However, an MI cable is unsuitable for winding into a coil since the density of its conductor cannot be increased. On the other hand, the glass braided tube insulated wire is inferior in heat resistance and its electrical and mechanical reliability leaves room for improvement since its internal layer may contain an organic material, and the density of its conductor cannot be increased. Thus, the glass braided tube insulated wire is also unsuitable for winding into a coil.

In a well-known method of manufacturing a coil of insulated wire, a mixture prepared by mixing and dispersing ceramic particles into a heat-resistant organic material is applied onto the outer surface of a conductor, dried or entirely heat treated to such a degree that the heat-resistant organic material is not completely decomposed, wound and again heated to thermally completely decompose the heat-resistant organic material contained in the wound wire, thereby fixing the ceramic particles around the conductor.

Also known is an alumite wire which is made oxidizing the surface of an aluminum conductor to form a thin ceramic wire which is flexible to some extent, and it is also possible to manufacture a heat-resistant insulated coil by winding such an aluminum conductor into a coil.

However, a wound coil is generally fixed with impregnation of an organic material such as enamel, in order to prevent dislocation of the wire turns caused by vibration or the like. Therefore, even if the aforementioned wire the surface of which is covered with a ceramic layer is employed for manufacturing a coil, a sufficient heat resistance cannot be attained when the coiled wire is fixed in the coil by an organic material.

In order to solve such a problem, Japanese Patent Laying-Open Gazette No. 63-237404 discloses a method of dipping a coil which is made by winding a wire in a solution of reacted metal alkoxide for applying the solution onto the surface of the coil and then converting the material forming the solution layer into oxide ceramics by heating. According to this method, it is possible to hold the wound wire in place by the oxide ceramics layer, thereby attaining a superior heat resistance as compared with the conventional method of employing an organic material.

In such a method, however, it is difficult to fill up voids between inner turns of the wire forming the coil, with the solution of metal alkoxide. When a wire formed by covering the surface of a conductor with a mineral insulating layer is wound into a coil, bending stress is applied to the mineral insulating layer to crack the same. In the method disclosed in the above prior art, it is impossible to fill the voids between the inner turns of the wire forming the coil with the reacted solution of metal alkoxide, whereby cracks caused in the organic insulating layer remains effective in reducing the breakdown voltage so that it is impossible to attain a high insulation ability which must originally be provided by the organic insulating layer.

SUMMARY OF THE INVENTION

It is an object of the present invention to provide a method of manufacturing an insulated coil of wire, which has a high insulation ability.

The present invention is directed to a method of manufacturing an insulated coil by winding a wire, which is formed by covering the outer peripheral surface of a conductor with a mineral insulating layer, into a coil. The present method comprises the steps of applying a precursor solution of an oxide insulating material onto the surface of the mineral insulating layer whereby the precursor oxide solution is applied, in an intermediate step between the application of the mineral insulating layer and the winding of the wire into a coil. After the completion of winding the wire, the precursor solution of the oxide insulating material is dried, and preferably heated to such an extent that the precursor solution is converted into a ceramic material.

The precursor solution of the oxide insulating material employed in the present invention is preferably prepared by hydrolyzing and polycondensing a metal alkoxide or a metal carboxylate containing at least one member selected from the group of Si, Al, Zr, Ti, and Mg, respectively.

In the present invention, the wire formed by covering the outer peripheral surface of a conductor with a mineral insulating layer may be prepared as follows, for example:

(1) an alumite wire formed by anodically oxidizing the surface of an aluminum conductor; or (2) a wire formed by applying silicon resin which is converted to ceramics by heating or a material prepared by mixing ceramic particles into the silicon resin, or a wire obtained by heating the resin layer to convert fully or partially the same to ceramics; or (3) a wire formed by applying a ceramic precursor solution which is prepared by hydrolyzing and polycondensing a raw material of a metal alkoxide or a metal carboxylate onto the surface of a conductor, or a wire obtained by converting fully or partially the material forming the solution layer to ceramics by heating.

Although such a wire is relatively flexible, a large number of cracks are caused in the surface layer or film when the wire is wound beyond the limit of toughness of the ceramics forming said mineral insulating layer since the insulating layer or film material is formed of ceramics. Such cracks lead to a breakdown of the insulation when the wire carries a current, as described above. The present invention is adapted to form a ceramic insulating layer in order to prevent such cracks by filling up the cracks with ceramics.

According to the present invention, the thickness of the mineral insulating layer is preferably not more than half the diameter of the conductor. If the thickness exceeds this value, the mineral insulating layer may be significantly damaged by the winding whereby it may become difficult to repair the damage by the application of the precursor solution of the oxide insulating material as taught by the invention. The cracking may be reduced by loose windings, but then it is impossible to increase the density of the conductor windings in the coil.

When the coil is used in a vacuum environment or the like, the precursor solution of the oxide insulating material which covers the surface of the mineral insulation layers, is preferably converted to ceramics by a heat treatment. Such conversion is adapted to reduce the possibility of gas evolution, thereby making the coil suitable for use in a vacuum.

However, it is not a requisite to convert the applied precursor solution to ceramics. If only a small number of cracks are caused in the mineral insulating layer which can be filled up with a small amount of the precursor solution, the solution may simply be dried. However, even in this case, it is also possible to convert the solution to ceramics by heat which is generated while the coil is being used.

According to the present method, it is possible to fill up voids and cracks, which may be caused in the mineral insulating layer by the winding operation, with the precursor solution of the oxide insulating material. Thus, it is possible to prevent a reduction in insulating ability that would otherwise be caused by cracks of the mineral insulating layer. According to the present invention, it is now possible to wind the coil tightly because void portions between inner turns of the wire are filled up with the precursor solution.

The metal alkoxide or metal carboxylate may be prepared as a solution having a relatively low viscosity. Thus, it is possible to apply the solution onto the surface of the mineral insulating layer and fill up fine cracks caused in the mineral insulating layer, thereby improving the insulating ability.

According to the present method, the precursor solution of the oxide insulating material is applied onto the surface of the mineral insulating layer in an intermediate step between the formation of the mineral insulating layer and winding the wire into a coil. Thus, void portions between inner turns of the wire forming the coil and cracks in the mineral insulating layer are filled up with the precursor solution of the oxide insulating material. Thus, a reduction of insulating ability is prevented and a high breakdown voltage is attained.

These and other objects, features, aspects and advantages of the present invention will become more apparent from the following detailed description of the present invention when taken in conjunction with the accompanying drawings.

DETAILED DESCRIPTION OF THE PREFERRED EMBODIMENT AND OF THE BEST MODE OF THE INVENTION

Figure 1:
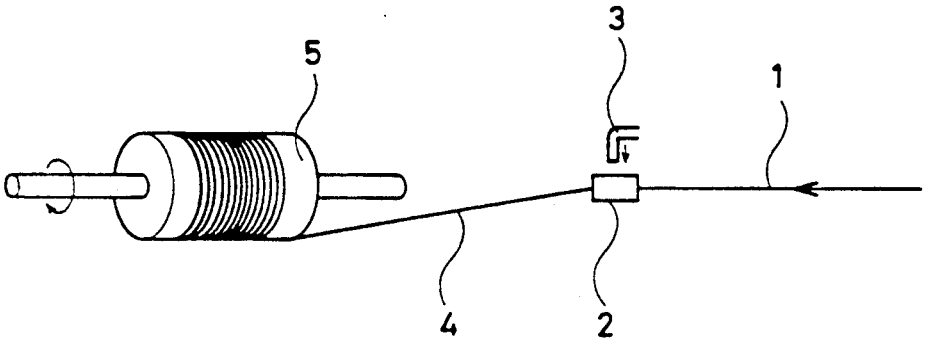
FIG. 1 is a schematic block diagram showing a method of manufacturing a coil according to the present invention.

Referring to FIG. 1, a wire 1, which is formed by covering the outer peripheral surface of a conductor with a mineral insulating layer, is passed through a felt mesh board 2. A precursor solution is dripped on the felt mesh board 2 from a precursor solution supply tube 3. Thus, the felt mesh board 2 is impregnated with the precursor solution which is applied onto the surface of the mineral insulating layer on the wire 1 as the wire passes through the felt mesh board 2. The wire 4 coated with the precursor solution is wound on a core 5.

Thus, the precursor solution is applied onto the surface of the mineral insulating layer 1 of the wire 1, and the coated wire 4 is wound into a coil downstream of the coating or applicator station as viewed in the travel direction of the wire.

Figure 2:
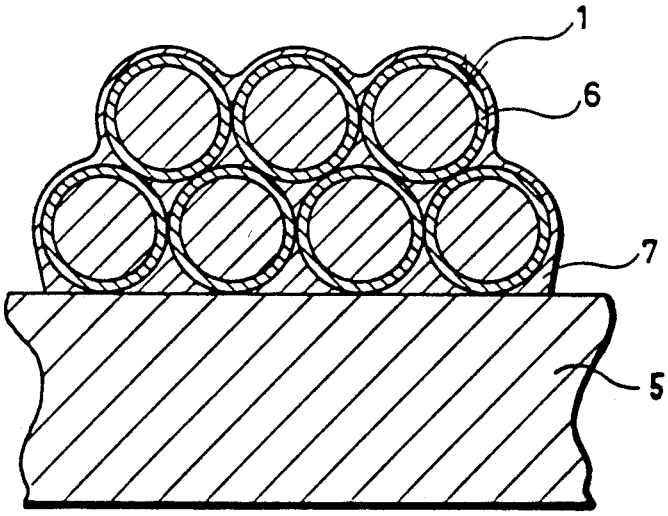
FIG. 2 is a sectional view showing a wire which is wound into a coil according to the present invention.

Referring to FIG. 2, a precursor solution filling layer 7 is formed between turns of the wire 1 which is wound on the core 5. As shown in FIG. 2, the precursor solution filling layer 7 is also coating the surfaces of the turns of the wire 1 for forming the inner part of a coil, whereby cracks that may have been caused in a mineral insulating layer 6 are filled up with the precursor solution filling layer 7. Thus, the coil manufactured according to the present method exhibits a high breakdown voltage. After winding, the precursor solution filling layer 7 is dried up. If necessary, the precursor solution filling layer 7 may be converted to ceramics by a heat treatment at a temperature higher than the drying temperature.

EXAMPLE 1

An aluminum wire having a diameter of 1 mm was covered with an oxide film of about 20 μm in thickness, to prepare an alumite wire, which exhibited a breakdown voltage of about 300 V.

This alumite wire was wound on a bobbin, while a solution of tetrabutoxysilane, which is an alkoxide of Si, was applied onto the surface of the alumite wire. The solution of tetrabutoxysilane was prepared by heating and mixing an alcohol solution, to which water and a catalyst were added, at 80° C. The alumite wire was wound on a bobbin of 100 mm in diameter with application of the solution of tetrabutoxysilane, and then the coil was heated on the bobbin at 300° C. for one hour. The wound alumite wire exhibited a breakdown voltage of at least 300 V before and after heating. No reduction of the breakdown voltage was recognized even if the coil of the alumite wire was heated to 400° C. for 10 hours.

For the purpose of comparison, an alumite wire similar to the above was wound on the same bobbin of 100 mm in bobbin diameter, with no application of the solution of tetrabutoxysilane. In this case, the breakdown voltage of the alumite wire was reduced to about 200 V, and partially to less than 100 V.

The comparison shows that the coil manufactured according to the present invention exhibits a high breakdown voltage also when the wire is wound into a coil.

EXAMPLE 2

6 g of 2-ethyl-hexanoic zirconate [$Zr[OC(O)CH(C_2H_5)C_6H_{12}]_4$] and 2 g of 2-ethyl-hexanoic aluminate [$Al[OC(O)CH(C_2H_5)C_6H_{12}]_3$] were dissolved in 100 ml of dibutyl ether. Thus, a Zr/Al mixed solution was prepared.

The Zr/Al mixed solution was applied onto a copper conductor having a diameter of 0.5 mm which was plated with a nickel layer of about 10 μm in thickness. The nickel layer was mineralized by a heat treatment performed at such a temperature that substantially no organic component was left, whereby the outer peripheral surface of the copper conductor was thus covered with a mineral insulating layer. The wire was wound on a bobbin just downstream of the application of the aforementioned Zr/Al mixed solution. This bobbin had a bobbin diameter of 50 mm. After the winding, the coil was heat treated in the atmosphere at 400° C. for two hours.

The resulting coil exhibited a breakdown voltage of 500 V.

EXAMPLE 3

A nickel-plated copper wire having a diameter of 1 mm was vapor-degreased with perchloroethylene. Concentrated nitric acid of 1.2N was added to a solution prepared by mixing 3 mole percent of tetraethyl orthosilicate, 35 mole percent of water and 62 mole percent of ethanol by 3/100 mol with respect to tetraethyl orthosilicate, and this mixture was heated and stirred at 70° C. for two hours, to prepare a coating solution. This coating solution was applied onto the surface of the vapor-degreased nickel-plated copper wire, which was then heat treated to produce a wire covered with silicon oxide.

5 m mol of n-butoxy zirconium, 15 m mol of n-butoxy aluminum, 45 m mol of ethanol amine and 100 ml of diethyleneglycolmonomethylether were mixed to prepare a solution a. On the other hand, 80 m mol of n-butyl silicate, 100 m mol of water, 1.6 m mol of nitric acid and 100 ml of diethylene glycol monomethyl ether were mixed, heated/stirred at 80° C. for five hours, and then stood for cooling to room temperature, thereby preparing a solution B.

The solution A was gradually dripped into the solution B. During such dripping, it is necessary to cool the solution B with ice. After the dripping was completed, the mixed solution was stirred in a constant humidity/-constant temperature bath at a temperature of 30° C. and 50% humidity for 10 hours, thereby preparing a coating solution.

This coating solution was applied onto the surface of the aforementioned wire having a mineral insulating layer, which was wound on a bobbin having a bobbin diameter of 30 mm. After completion of the winding, the coil was heat treated in the atmosphere at 200° C. for four hours to convert partially to ceramics.

The by resulting coil exhibited a breakdown voltage of 800 V.

Any coil manufactured according to the present invention exhibits a high breakdown voltage, which cannot be attained by the prior art.

The precursor solution of the oxide insulating material is applied onto the wire which is not yet wound on the bobbin. In a modification of the present invention, the precursor solution may be applied onto a wire which is being wound on a bobbin. In this case, the precursor solution is successively applied to the surfaces of the turns of the wire which is being wound on the bobbin.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of manufacturing an insulated coil by winding an insulated wire to form said coil, comprising the following steps:

(a) covering an outer peripheral surface of a conductor with a mineral insulating layer, (b) selecting a precursor solution of an oxide insulating material from the group consisting of an alkoxide and a carboxylate, (c) selecting said alkoxide as at least one alkoxide of a member from the group consisting of Si, Al, Zr, Ti, and Mg, (d) further selecting said carboxylate as at least one carboxylate of a member from the group consisting of Si, Al, Zr, Ti, and Mg, (e) applying the selected precursor solution to said mineral insulating layer to form a coated wire, (f) winding said coated wire into a coil, and (g) drying said precursor solution on the surface of said wire after winding said wire.

2. The method of claim 1, wherein said drying step comprises heating said coil sufficiently for converting said precursor solution of said oxide insulating material into ceramics.

3. The method of claim 1, wherein said mineral insulating layer has a thickness not more than half the diameter of said conductor.

4. The method of claim 1, wherein said step of applying said precursor solution to said mineral insulating layer is performed on said wire upstream of said winding as said wire is travelling through a precursor solution applicator toward said winding.

5. The method of claim 1, wherein said step of applying said precursor solution to said mineral insulating layer is performed by successively coating surfaces of turns of wire being wound onto a coil.

* * * * *